US007439688B2

(12) United States Patent
Ishibashi et al.

(10) Patent No.: US 7,439,688 B2
(45) Date of Patent: Oct. 21, 2008

(54) DISCHARGE LAMP LIGHTING CIRCUIT WITH POWER CONTROL

(75) Inventors: Hiroki Ishibashi, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 411 days.

(21) Appl. No.: 10/879,578

(22) Filed: Jun. 30, 2004

(65) Prior Publication Data

US 2005/0029964 A1 Feb. 10, 2005

(30) Foreign Application Priority Data

Jul. 1, 2003 (JP) ..... P. 2003-189277

(51) Int. Cl.
*G05F 1/00* (2006.01)

(52) U.S. Cl. ..... 315/307; 315/291; 315/297; 315/224; 315/247

(58) Field of Classification Search ..... 315/307, 315/291, 297, 224, 225, 247
See application file for complete search history.

(56) References Cited

U.S. PATENT DOCUMENTS

| | | | | |
|---|---|---|---|---|
| 6,153,987 | A | 11/2000 | Toda et al. | |
| 6,351,074 | B1 | 2/2002 | Ito et al. | |
| 6,750,620 | B2 * | 6/2004 | Suzuki | 315/291 |
| 2004/0090188 | A1 | 5/2004 | Ishizuka et al. | |

FOREIGN PATENT DOCUMENTS

| | | | |
|---|---|---|---|
| DE | 4015398 | A1 | 11/1991 |
| DE | 19924516 | A1 | 1/2000 |
| DE | 10006796 | A1 | 8/2000 |
| DE | 602004001695 | T2 | 8/2007 |
| EP | 0 536 535 | A1 | 4/1993 |
| JP | 7-065982 | A | 3/1995 |
| JP | 9-330795 | A | 12/1997 |
| JP | 2003-151787 | A | 5/2003 |

OTHER PUBLICATIONS

Xu Dianguo, et al., "Novel Control Strategies for HPS Lamps Driven by Electronic Ballast", vol. 1 of 4. Conf. 37, Oct. 13, 2002, pp. 1852-1855, XP010610130.
German Office Action dated Jun. 4, 2008.
Japanese Office Action dated May 27, 2008.

* cited by examiner

*Primary Examiner*—Tuyet Vo
(74) *Attorney, Agent, or Firm*—Sughrue Mion, PLLC

(57) ABSTRACT

A discharge lamp lighting circuit includes an emission acceleration controller for detecting a voltage for a discharge lamp and for supplying power exceeding a rated value when the discharge lamp is initially lighted, and thereafter gradually reducing the power to shift the discharge lamp to a steady state. While the value of the power supplied when the lighting of the discharge lamp is started is employed as the maximum, the power supplied to the discharge lamp is controlled. Thus, the speed at which the power is reduced during a period of transition to the steady state is increased in consonance with an increase in the discharge lamp voltage.

8 Claims, 6 Drawing Sheets

DISCHARGE LAMP LIGHTING CIRCUIT WITH POWER CONTROL

This application claims foreign priority based on Japanese patent application JP 2003-189277, filed on Jul. 1, 2003, the contents of which is incorporated herein by reference in its entirety.

BACKGROUND OF THE INVENTION

1. Field of the Invention

The present invention relates to a method for increasing the rising time for a luminous flux used with a lighting circuit for lighting a discharge lamp that contains either no mercury or only a small amount of mercury as a luminescent material.

2. Description of the Related Art

A related art discharge lamp lighting circuit configuration includes a direct-current power source circuit, a DC-AC converter and a starting circuit (i.e., a starter). With this related art configuration, the discharge lamp lighting circuit, while in a steady state, supplies a rated power to a discharge lamp.

To quickly raise the luminous flux of the discharge lamp, during a transition period immediately following the lighting of the discharge lamp, power exceeding the rated power is supplied to the discharge lamp to accelerate the emission of light (see JP-A-9-330795, for example).

For a related art circuit for lighting a discharge lamp containing mercury, during a transition period extending from immediately following the lighting of the discharge lamp until it is shifted to the steady state, a lamp current (or power to be supplied) corresponding to a lamp voltage is regulated, i.e., a control process is performed based on a so-called control line.

When related art discharge lamps are employed as the light source for a vehicle, safety requirements dictate that an adequate startup procedure be provided, so that the luminous flux rises to the steady value as quickly as possible.

However, when a discharge lamp that contains no mercury, or only a small amount of mercury, is to be lighted by using the related art process for lighting a discharge lamp containing mercury, various problems occur. For example, but not by way of limitation, some of these problems are discussed in greater detail below.

FIG. 7 is a schematic graph, showing a time-transient change in a luminous flux. The horizontal axis represents a time "t" while the vertical axis represents a luminous flux "L".

A graph curve ga in FIG. 7 represents a change in the luminous flux when a discharge lamp containing mercury is lighted using a lighting circuit, while graph curves gb and gc represent changes in the luminous flux that occur when a discharge lamp containing no mercury is lighted using the same related art lighting circuit. The graph curve gb shows an overshoot, while the graph curve gc shows an undershoot. In either case with non- or low-mercury light, deterioration of the rising characteristic of the luminous flux occurs.

The reasons for the foregoing problems are briefly explained below.

(1) When a specific constant power is supplied to a discharge lamp that contains mercury, the lamp voltage begins to increase immediately following the lighting of the discharge lamp. After a short delay, the luminous flux rises. However, when power is supplied to a discharge lamp that does not contain mercury, a constant relationship between the increase in the lamp voltage and the rise in the luminous flux is not established following the lighting of the discharge lamp.

For a discharge lamp that contains mercury and to which power is supplied in accordance with the lamp voltage, a rise in the lamp voltage that precedes a rise in the luminous flux is observed. However, for a discharge lamp that does not contain mercury, such a power supply control does not always work.

(2) When the related art power supply based on the control line is performed for a discharge lamp that does not contain mercury, and the timing for starting the reduction in the supplied power is shifted away from the rising point of the luminous flux, this shift causes the overshoot or the undershoot described above.

For a discharge lamp that does not contain mercury as a luminescent material, there is no material for emitting light immediately after the discharge lamp is lighted. Therefore, as light emission is started from metal iodide, the light flux rises sharply, and the rising point varies instead of being constant relative to the period that has elapsed since the lighting process began and the lamp voltage.

For example, referring to a graph line gd showing a lamp voltage (VL)—power (P) characteristic in FIG. 8, assume that a discharge lamp A, for which a point PA is regarded as the rising point for the luminous flux, is compared with a discharge lamp B, for which a point PB whereat a lamp voltage is higher, is regarded as the rising point of the luminous flux (a point PO0 represents a preferable reference point as the rising point of the luminous flux). Since after the point PA the maximum power is still being supplied to the discharge lamp A, the overshoot occurs, while before the point PB, as the power supplied for the discharge lamp B is gradually being reduced, the undershoot occurs.

(3) Since the initially supplied power must be increased for a discharge lamp that does not contain mercury, and the lamp voltage in the steady state is low, only a small effective range is obtained for the emission acceleration control based on the control line. Thus, the affect of the variance in the lamp voltage supplied to the luminous flux is greater than when a discharge lamp that contains mercury is employed.

FIG. 9 is a graph showing an example lamp voltage—lamp current characteristic, while the horizontal axis represents a lamp voltage "VL" and the vertical axis represents a lamp current "IL". A power control line "C1" is a control line related to a discharge lamp that contains mercury, and a power control line "C2" is a control line related to a discharge lamp that does not contain mercury. As is apparent from the comparison of the inclinations (dIL/dVL) of the control lines during a transition period, the inclination of the power control line C2 is greater, so that the effective range for the emission acceleration control (see double-headed arrow "R") is narrow. Therefore, when, for two discharge lamps for which the lamp voltage changes differ, the reduction in the supplied power, according to the control lines, is started at the same lamp voltage level, the time-transient changes in the luminous fluxes greatly different.

For example, even when the lamp voltages of the two discharge lamps A and B reach the same level, for the discharge lamp A, this time immediately follows the rise in the lamp voltage, and the reduction in the power supplied is started. On the other hand, for the other discharge lamp B, this is the time that has elapsed since the rise in the lamp voltage. Accordingly, excessive power is supplied to the discharge lamp B, so that the overshoot occurs (or, when the power supplied is controlled (power reduction) by using, as a reference, the change in the lamp voltage of the discharge lamp B, the undershoot occurs for the luminous flux of the discharge lamp A).

SUMMARY OF THE INVENTION

It is an object of the present invention to quickly raise a luminous flux, using a process for controlling power during a transition period, for a discharge lamp that contains no mercury, or only a small amount of mercury, as a luminescent material. However, it is not necessary for the foregoing object, or any other object to exist for the present invention, and embodiments, equivalents and variations thereof.

To achieve this objective, the present invention includes the following configuration.

A discharge lamp lighting circuit is provided that comprises an emission acceleration controller for supplying power higher than a rated value when a discharge lamp is initially lighted, and for there after gradually reducing the power supplied to shift the discharge lamp to a steady state.

The emission acceleration controller controls the power supplied to the discharge lamp, so that during the period for the transition to the steady state, the speed at which the power supplied is reduced is increased as the lamp voltage increases.

Therefore, according to the present invention, in the process for controlling the power supplied to the discharge lamp during the transition period, the power supplied is quickly reduced as the lamp voltage increases. Therefore, even when such a discharge lamp is employed that the relationship along the time axis is not constant between the rising point for the lamp voltage and the rising start point for the luminous flux, in order to reduce and stabilize the starting time period the time-transient reduction rate for the power supplied need only be controlled in accordance with the lamp voltage.

DETAILED DESCRIPTION OF THE INVENTION

Figure 1:
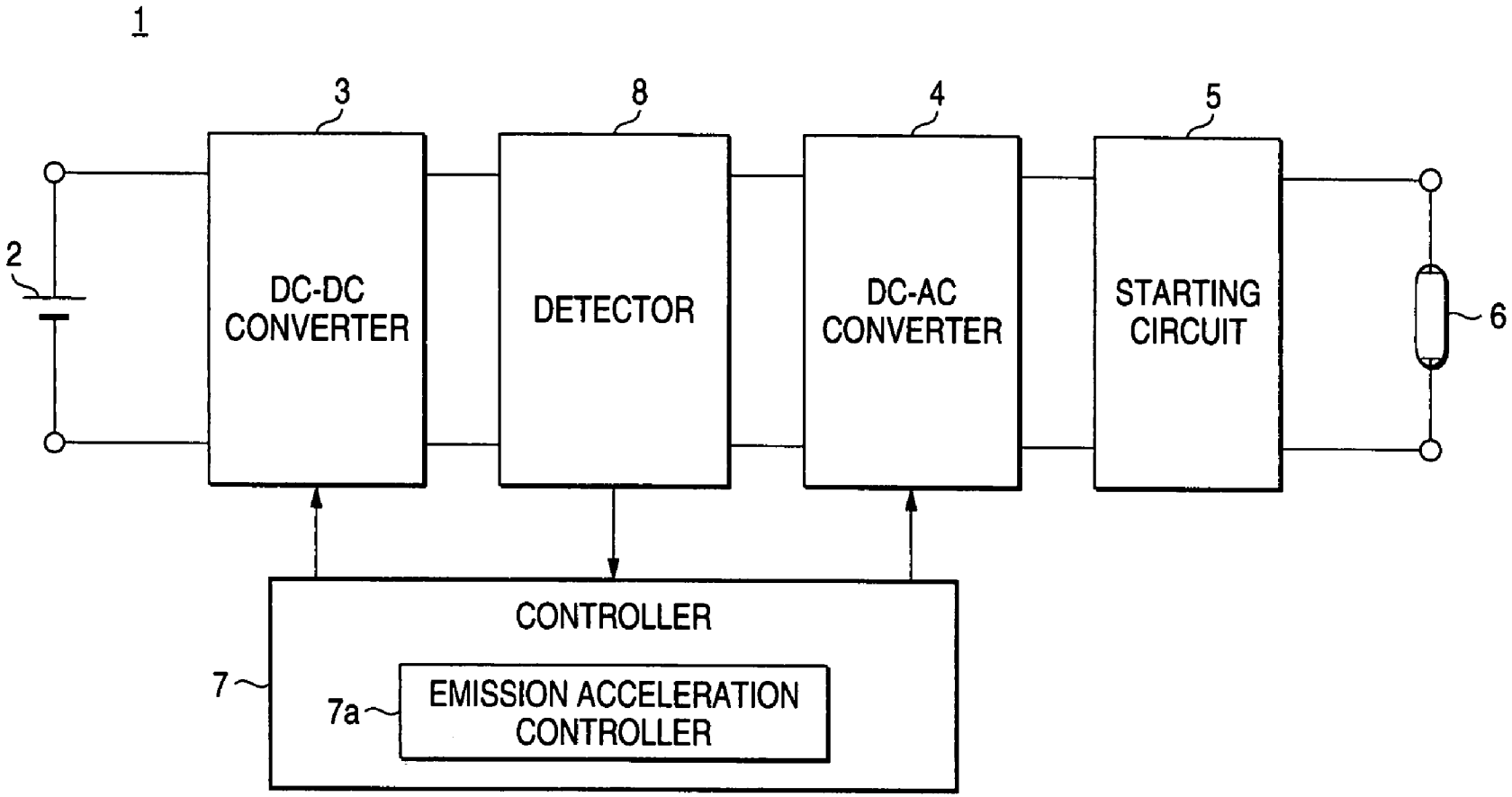
FIG. 1 is a circuit block diagram showing an exemplary, non-limiting basic configuration for a discharge lamp lighting circuit according to the present invention.

An exemplary, non-limiting basic configuration for the present invention is shown in FIG. 1. A discharge lamp lighting circuit 1 comprises a direct-current power source 2, a DC-DC converter 3, a DC-AC converter 4 and a starting circuit 5.

The DC-DC converter 3 raises or lowers the voltage of a current received from the DC power source 2, and outputs a desired DC voltage. The output voltage of the DC-DC converter 3 varies in accordance with a control signal received from a controller 7, which will be described later. The DC-DC converter 3 can be a DC-DC converter (e.g., a chopper or a flyback type) having a switching regulator.

The DC-AC converter 4 changes the output voltage of the DC-DC converter 3 into an AC voltage, and supplies the AC voltage to a discharge lamp 6. The DC-AC converter 4 can include a bridge circuit (a full bridge circuit or a half bridge circuit) including a plurality of semiconductor switching devices, and a driver for the bridge circuit.

The starting circuit 5 generates a high voltage signal (start pulse) and supplies this signal to the discharge lamp 6 to be activated. The high voltage signal is superimposed with the AC voltage output by the DC-AC converter 4, and the resultant signal is applied to the discharge lamp 6.

In this exemplary, non-limiting embodiment, either the discharge lamp 6 does not contain mercury, or alternatively, contains only a small amount of mercury. The material included in the discharge lamp (e.g., a metal halide lamp) is xenon (Xe) or metal iodide, or the like as would be understood by one of ordinary skill in the art. As described above, for a discharge lamp that contains mercury, since the rise in the lamp voltage precedes the rise in the luminous flux, the power supplied can be controlled while the lamp voltage is monitored. However, for a discharge lamp that contains no mercury or alternatively, a small amount of mercury, the lamp voltage does not necessarily rise prior to the rise in the luminous flux. Thus, a control process that differs from the related art predictive control process is required.

The following arrangements can be employed for a detector for detecting the voltage or the current of the discharge lamp 6.

(A) An arrangement wherein, to directly detect the voltage or the current of a discharge lamp, a current detection device (e.g., a shunt resistor or a detection transformer) is coupled to the discharge lamp to detect the current across the current detection device.

(B) An arrangement wherein an equivalent voltage for the lamp voltage or the lamp current of a discharge lamp is detected.

In FIG. 1, the arrangement (B) is shown, and a detector 8 is located between the DC-DC converter 3 and the DC-AC converter 4. An exemplary, non-limiting voltage detector can be a circuit for detecting the output voltage using a voltage-divided resistor while a current detector can be a circuit using a detection resistor, and the detection signals are transmitted to the controller 7.

The controller 7 includes not only a function for controlling the power supplied to the discharge lamp 6 and a function for driving the DC-AC converter 4, but also a fail-save function for determining whether an abnormality has occurred in the state or the operation of the circuit. The following exemplary, non-limiting configurations can be employed for the controller 7.

(I) A configuration wherein control logic is provided by an analog circuit or a logic circuit to use hardware to provide the individual functions.

(II) A configuration wherein an arithmetic operation unit, such as a micro computer, is employed that uses software to provide the individual functions.

The configurations (I) and (II) may also be employed together, and various forms are available, e.g., special circuits can be employed to provide the function for driving the DC-AC converter 4 and the fail-safe function. A micro computer can be in charge of the other functions.

The controller 7 has a power control function in the steady state of the discharge lamp 6 and a power control function in the transient state. That is, the controller 7 includes an emission acceleration controller 7*a* for controlling the power supplied to the discharge lamp 6 in the steady state (constant power control), in accordance with a detection signal for the voltage applied to the discharge lamp 6 and a detection signal for the current flowing through the discharge lamp 6, and for also, before performing this power control process, controlling power supplied to the discharge lamp 6 during a transition period.

With this arrangement, the controller 7 controls the output of the DC-DC converter 3. A power larger than the power supplied in the steady state must be supplied in a time-transient manner, so that the light emitted by the discharge lamp 6 is accelerated to raise the luminous flux of the discharge lamp to the luminous flux in the steady state within a short period of time.

Figure 2:
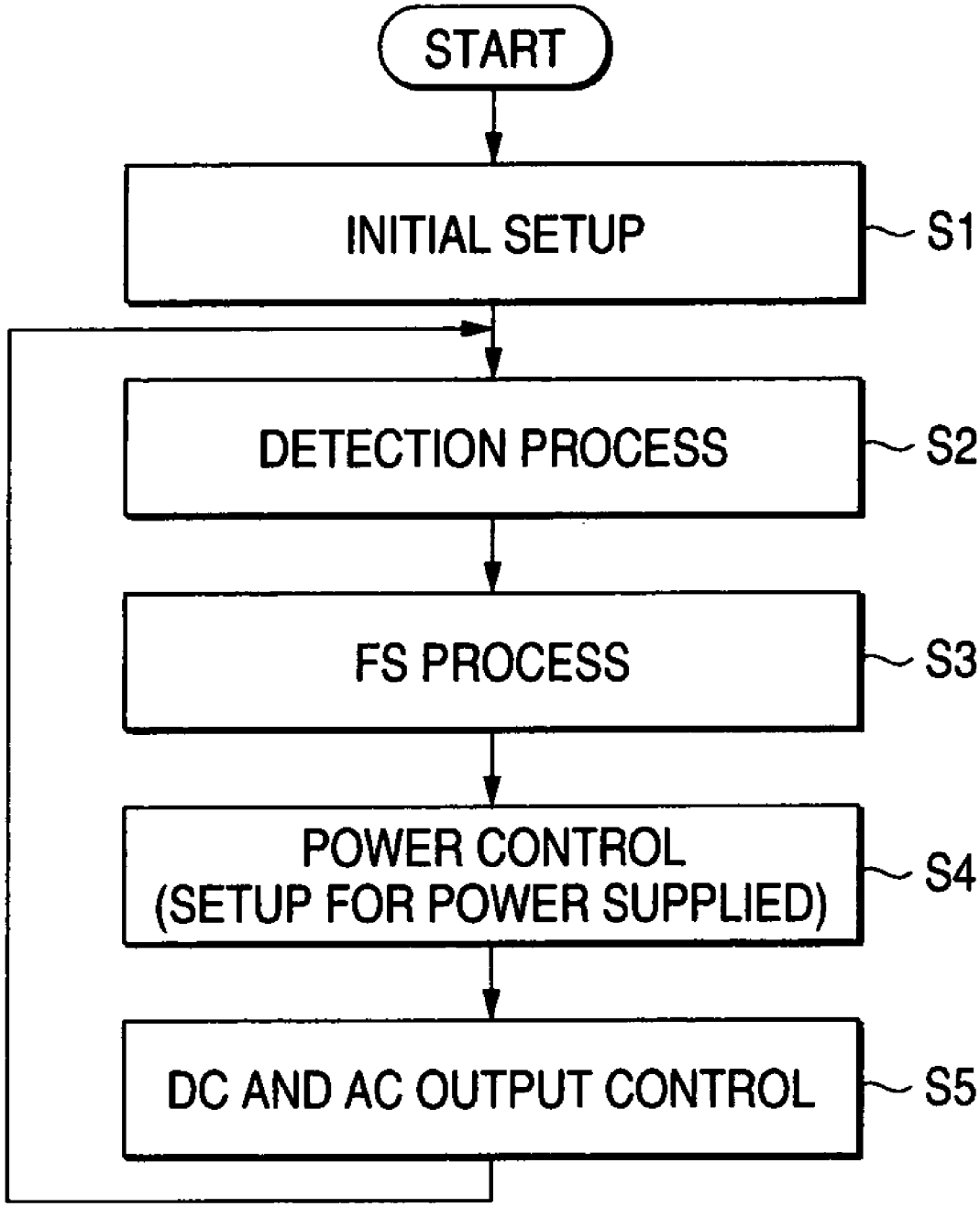
FIG. 2 is a flowchart for explaining the exemplary, non-limiting basic control process according to the present invention.

FIG. 2 is a flowchart for explaining example basic control processing according to an exemplary, non-limiting embodiment of the present invention. With the configuration (II), for example but not by way of limitation, the processes at steps S1 to S5 are performed in accordance with a program that is translated and executed by a CPU (Central Processing Unit) (not shown). This may be a set of instructions contained in a computer-readable medium, such as a memory device or the like, for executing instructions corresponding to the following steps.

(S1) Initial setup (S2) Detection process (S3) FS (fail-safe) process (S4) Power control (setup for power supplied)

(S5) DC and AC output control

When power is supplied to a lighting circuit and an instruction for starting the lighting of a discharge lamp is issued, the initial setup is performed at step S1. Next, at step S2, a battery voltage, a lamp voltage and a lamp current are detected, and an analog (A)—digital (D) conversion is performed for the detection signals to obtain measurement data processed by the controller 7.

At step S3, a check is performed to determine whether the state and the operation of the circuit are normal. When it has been determined that lighting the discharge lamp presents no problems, program control advances to step S4 and the supply of power is controlled as described below.

At step S4, the value of the power supplied is designated at an appropriate time, in accordance with the state of the discharge lamp. Power control is accordingly performed in the transition state and the steady state at the initial lighting time. The controller 7 includes the luminescent acceleration controller 7*a* for obtaining detection information for the voltage of the discharge lamp and supplying, to the discharge lamp in the initial lighting state, power exceeding the rated value, and thereafter gradually reducing the power supplied to shift the discharge lamp to the steady state. With the configuration (II), for example, the CPU and the program are employed to perform this processing.

The rising characteristic of the luminous flux for the discharge lamp depends on the lamp voltage (VL). Since the rising time for the luminous flux is shortened as the lamp voltage becomes higher, supplied power (P) must be reduced as the lamp voltage is increased, and this predictive power control process requires the inclusion of the concept of time relative to the change in the power.

Therefore, according to the present invention, as will be described later, during the transition period, until the discharge lamp is shifted to the steady state, the speed ($|dp/dt|$) for reducing the power supplied to the discharge lamp is controlled in accordance with the lamp voltage. Thus, the power control process can be performed while taking the lamp voltage (VL) and the time (t) into account.

At step S5, the DC-DC converter 3 and the DC-AC converter 4 are controlled in accordance with control signals received from the controller 7. That is, when a control signal is transmitted to the DC-DC converter 3, the output voltage is controlled, while a control signal is transmitted to the DC-AC converter 4 to change the polarity relative to the alternating output. The PWM (Pulse Width Modulation) method and the PFM (Pulse Frequency Modulation) method are well known switching methods that are used for the DC-DC converter 3, as would be well-known by those of ordinary skill in the art.

Following step S5, program control returns to step S2, and steps S2-S5 are repeated.

Although not shown in FIG. 2, when an abnormality such as a reduced battery voltage occurs at step S3 and protection for the discharge lamp and the circuit is required, either the supply of power to the discharge lamp is halted or an alarm is generated.

Figure 3:
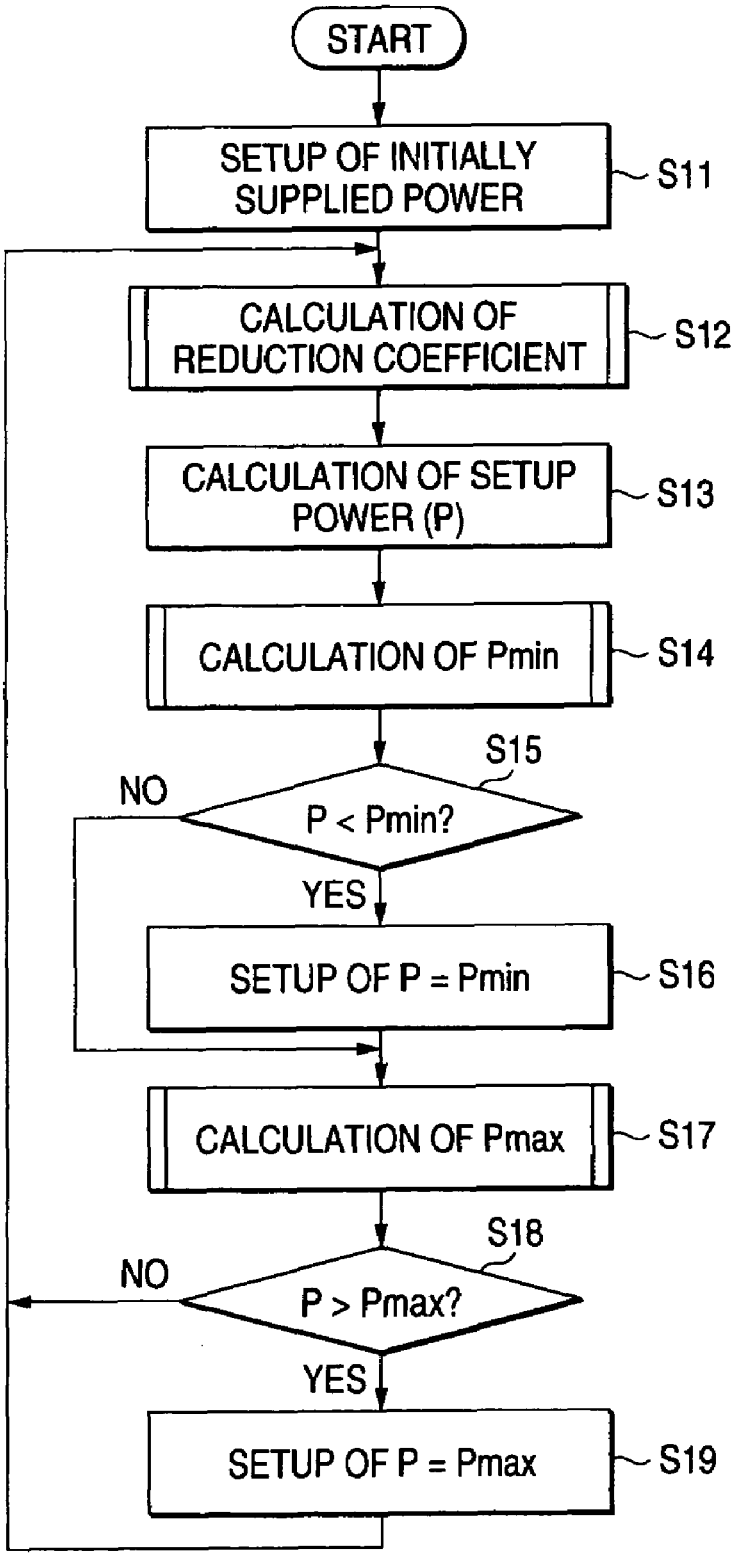
FIG. 3 is a flowchart showing exemplary, non-limiting power control process according to the present invention.

FIG. 3 is a flowchart showing exemplary, non-limiting power control processing that is performed, in accordance with steps S11 to S19.

(S11) Setup of initially supplied power (S12) Calculation of a reduction coefficient (k)

(S13) Calculation of setup power (P)

(S14) Calculation of minimum supplied power (Pmin)

(S15) Determination of a condition for a supplied power value (program control advances to step S16 when $P<Pmin$ is established, or is shifted to step S17 when $P \geqq Pmin$ is established)

(S16) Setup of minimum supplied power (Pmin)

(S17) Calculation of maximum supplied power (Pmax)

(S18) Determination of a condition for a supplied power value (program control advances to step S19 when $P>Pmax$ is established)

(S19) Setup of maximum supplied power (Pmax)

At step S11, the initial value for the power supplied to the discharge lamp is designated in accordance with the time when the discharge lamp was turned off (i.e., time elapsed since the previous OFF time). For example, when a comparatively long time has elapsed since the cooled discharge lamp was turned off, and the discharge lamp is to be lighted (i.e., a cold start), the power to be supplied is several times the constant power.

However, when the time elapsed since the discharge lamp was turned off is not very long and the discharge lamp to be lighted is comparatively warm (i.e., a hot start), the power that is supplied is only slightly higher than the rated power. To detect the degree to which the discharge lamp has cooled and the time when the discharge lamp was turned off, several configurations can be employed. As one non-limiting example, a capacitor may be fully charged while the discharge lamp is lighted, and when, in accordance with a lighting halt instruction, the discharge lamp is turned off, the discharge of the capacitor starts. Thus, the next start time, the smaller the charge remaining on the capacitor, the longer the period of time since the lamp was turned off, so that to obtain the light OFF time, only the terminal voltage of the capacitor need be detected. As another non-limiting example, information indicating the time the discharge lamp was turned off may be stored in nonvolatile memory, and the light OFF time may be obtained by calculating the difference between the stored time and the current time.

At step S12, the value of a reduction coefficient (k) is calculated to determine the reduction rate for the power supplied during the transition period for the discharge lamp. The reduction coefficient is defined as a positive value equal to or smaller than one and conversely, is reduced as the lamp voltage is increased. That is, the reduction coefficient (k) is a function of the lamp voltage VL and is "1" for no power reduction. The smaller the value of the lamp voltage VL, the greater the power reduction rate.

An example for the lamp voltage and the reduction coefficient value is shown in Table 1 ("~MAX" represents "VL>37").

TABLE 1

| lamp voltage (unit: V) | 0-33 | 33-34 | 34-35 | 35-36 | 36-37 | -MAX |
|---|---|---|---|---|---|---|
| reduction coefficient value | 1 | 1-0.999 | 0.999-0.998 | 0.998-0.997 | 0.997-0.995 | 0.995 |

In this embodiment, the reduction coefficient k=1 when the lamp voltage is 0 to lower than 33 V, and is gradually reduced as the lamp voltage is increased. When the lamp voltage exceeds 37 V, the reduction coefficient value becomes a constant value. That is, a first threshold value, and a second threshold value smaller than the first threshold value, are defined for the lamp voltage. When the lamp voltage is equal to or greater than the threshold value, the reduction coefficient is defined as a constant value smaller than one.

When the lamp voltage is smaller than the second threshold value, the reduction coefficient is defined as one. Through this setup, the power control process can be performed while taking into account variances in the lamp characteristics, such as a difference in the lamp voltage in the steady state and a high or low initial lamp voltage. As a result, the rising time for the luminous flux can be substantially constant.

The first threshold value is set to prevent the related art undershoot problem. When the first threshold value is not set, the speed for reducing the power supplied is too high in a discharge lamp for which the lamp voltage of the steady state is high. Therefore, it is preferable that the first threshold value be set to a point where overshoot of the luminous flux does not occur for a discharge lamp in which the lamp voltage of the steady state is low, or where undershoot of the luminous flux does not occur in a discharge lamp of which the lamp voltage in the steady state is high.

The second threshold value is set to regulate a period during which the supply of the initial power continues from the lighting start. When the second threshold value is not set, the initially supplied power is uniformly defined only in accordance with the elapse of time. As a result, overshoot tends to occur for a discharge lamp for which the lamp voltage in the initial lighting state is high. Further, even when the supply of a large initial power is not required (e.g., when the discharge lamp is turned off and then immediately turned on (hot start)), excessive power is supplied until a predetermined period of time has elapsed.

To avoid the foregoing situations, the second threshold value should be set to a point where, for a discharge lamp in which the initial lamp voltage is low, a satisfactory initial power is supplied to prevent undershoot of the luminous flux, or where, for a discharge lamp for which the initial lamp voltage is high or during a hot start, only the power is supplied necessary to prevent overshoot of the luminous flux.

At step S13, the reduction coefficient k is employed to calculate the value of the setup power P by using, for example, the following equation.

$$P=S(Pa-Pb)\times k+Pb$$

wherein Pa denotes the current value of the setup power, and Pb denotes a reference value. The function S(X) establishes S(X)=X when X≧0, or S(X)=0 when X<0. This equation represents the case Pa≧Pb.

When an initial power of about 90 W is supplied to a discharge lamp having a rated power of 35 W, and the supplied power is thereafter gradually reduced, the transient state for 45 W is present before the power reaches 35 W (in this case, the value Pb is 45 W). When the supplied power value approaches 35 W, and when the reduction rate for the supplied power is too great, undershoot occurs as the luminous flux is changed in accordance with the time axis. Therefore, it is preferable that, after the supplied power reaches 45 W, the reduction rate be reduced and the discharge lamp be gradually shifted to the steady state. That is, when the value of the power supplied to the discharge lamp approaches the rated power value, the value Pb is employed as a reference value to thereafter gradually reduce the reduction rate for the supplied power. The value Pb is determined in accordance with the characteristic of the discharge lamp.

As described above, the reduction coefficient value is changed in accordance with the lamp voltage. Also, as the supplied power is gradually reduced in accordance with the detection results obtained for the lamp voltage, the transient state is shifted to the steady state.

As described above, when the power value at the time the lighting of a discharge lamp is started is employed as the maximum value, power control is performed for the discharge lamp, so that the speed for reducing the power supplied during the period of transition to the steady state is high when the lamp voltage is high.

It is preferable that the upper limit and the lower limit be set for the thus calculated power value.

At step S14, the minimum value Pmin of the supplied power is calculated in accordance with the lamp voltage VL. For example, as is shown in Table 2 (MAX represents VL>36), the value Pmin is reduced as the lamp voltage is raised, so that the lower limit value of the power supplied is reduced.

TABLE 2

| lamp voltage (unit: V) | 30 | 31 | 32 | 33 | 34 | 35 | 36 | MAX |
|---|---|---|---|---|---|---|---|---|
| minimum power (unit: W) | 85 | 80 | 80 | 75 | 70 | 70 | 33 | 33 |

At step S15, the power P obtained by the equation described above is compared with the power Pmin based on Table 2. When the power P is smaller than the power Pmin, program control advances to step S16 and the power Pmin is reset as the power P. When the power P is equal to or greater than the power Pmin, program control is shifted to step S17.

Since the lower limit value of the supplied power is regulated in accordance with the lamp voltage, undershoot of the luminous flux can be prevented. When the lower limit value is a constant, a shortage of power occurs when the lamp voltage is low.

At step S17, the maximum value Pmax of the supplied power is calculated in accordance with the time (t) elapsed since the discharge lamp lighting start. For example, as shown in Table 3 ("~MAX" represents "t>60"), the value Pmax is smaller as the elapsed period is lengthened, so that the upper limit value of the power P is reduced.

TABLE 3

| elapsed period (unit: seconds) | 0-4 | 4-7 | 7-11 | 11-15 | 15-60 | -MAX |
|---|---|---|---|---|---|---|
| maximum power (unit: W) | 91 | 91-85 | 85-65 | 65-45 | 45-36 | 36 |

At step S18, the power P obtained by the above equation is compared with the power Pmax based on Table 3. When the power P exceeds the power Pmax, program control advances to step S19 and the power Pmax is set as the power P. When the power P is equal to or smaller than the power Pmax, program control is returned to step S11.

Since the upper limit value of the power supplied is regulated in accordance with the time that has elapsed since the discharge lamp lighting start, overshoot of the luminous flux can be prevented (if the upper limit value is a constant, excessive power will be supplied to the discharge lamp).

Tables 1 to 3 may be stored as table reference data in a memory. Alternatively, when the tables can be represented by using functions, mathematical expressions may be written into a program. While referring to FIG. 3, the value P has been calculated first, and then the lower limit value and the upper limit value have been defined in the named order. However, various other ways may be employed, e.g., the value Pmax and the value Pmin may be calculated in the reverse order, and the upper limit value and the lower limit value may be defined in this order.

The processes performed at steps S12 to S19 are repetitively performed, as a loop.

Figure 4:
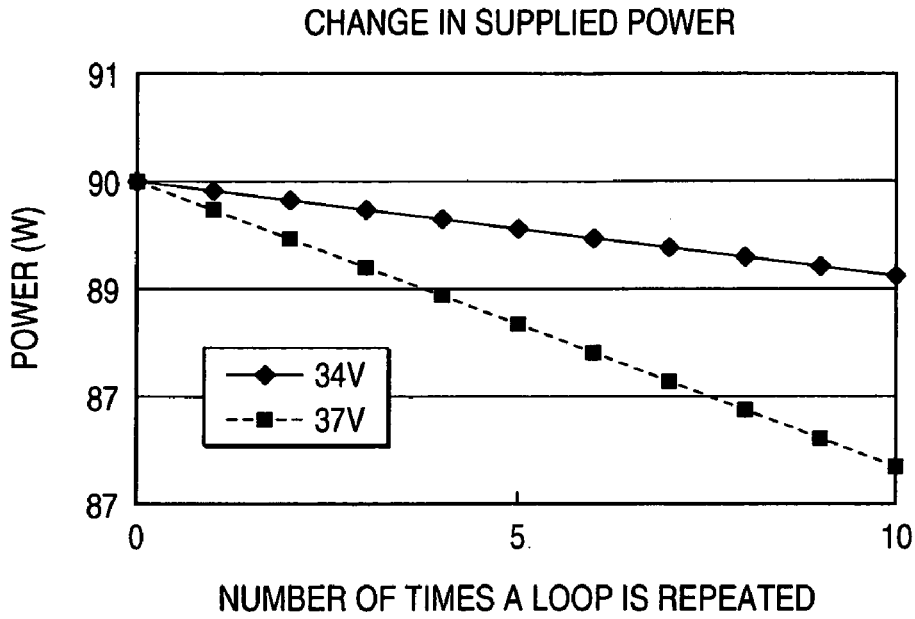
FIG. 4 is a graph showing an exemplary, non-limiting power change.

FIG. 4 is a graph, showing an example power change, wherein the horizontal axis represents the number of times a loop is repeated and the vertical axis represents the power supplied to a discharge lamp. In this graph, the degree of reduction differs for the lamp voltages 34 V and 37 V. In both cases 90 W is initially supplied.

For ease of explanation, the lamp voltage is set as constant, and unlike the related art method that uses the control line, even when the lamp voltage is constant along the time axis, the power supplied is reduced as the number of repetitions of the loop is increased.

In the comparison process performed for the 34 V and 37 V lamp voltage cases, the reduction coefficient value is comparatively small when the lamp voltage is high (37 V), so that the speed at which the supplied power is reduced is increased. According to this setup for the reduction coefficient, a predictive control process is enabled. Since the number of loop repetitions employed is consonant with the elapsed time, and since the time concept described above is included, the control line in this case should not simply be compared with a control line that does not include the time concept. When the control line in the lamp voltage—lamp current characteristic graph is employed, the time that a specific operating point on the control line is shifted to another operating point can not be read, and the shifting time is not constant.

Figure 5:
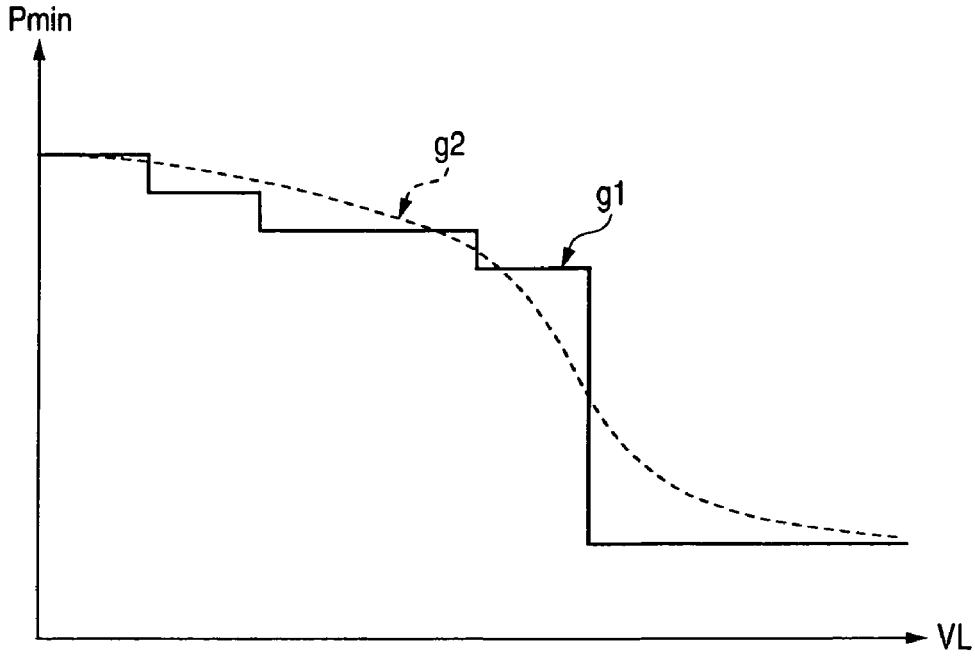
FIG. 5 is a graph showing an exemplary, non-limiting relationship between a lamp voltage VL and a minimum value Pmin of the power supplied.

FIG. 5 is a graph showing an exemplary, non-limiting relationship between the lamp voltage VL and the minimum value Pmin of the power supplied to the discharge lamp, wherein the horizontal axis represents the lamp voltage VL and the vertical axis represents the minimum value Pmin. As the lamp voltage is increased, the minimum value Pmin is reduced either step by step (see graph curve g1) or continuously (see graph curve g2).

Figure 6:
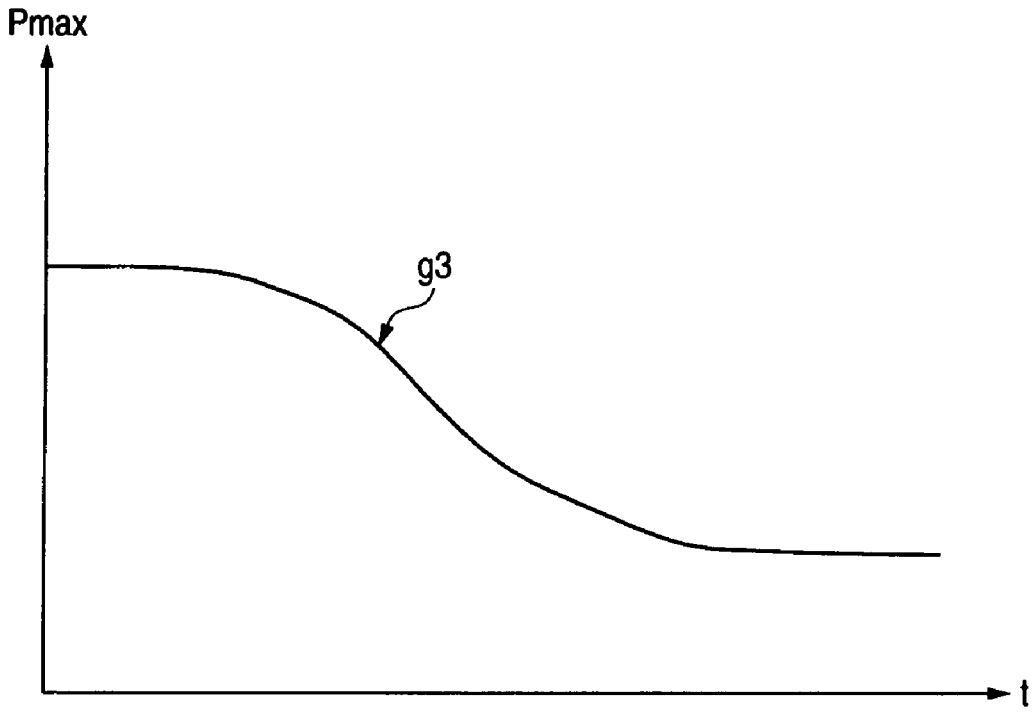
FIG. 6 is a graph showing an exemplary, non-limiting relationship between an elapsed time t and a maximum value Pmax of the power supplied.
Figure 7:
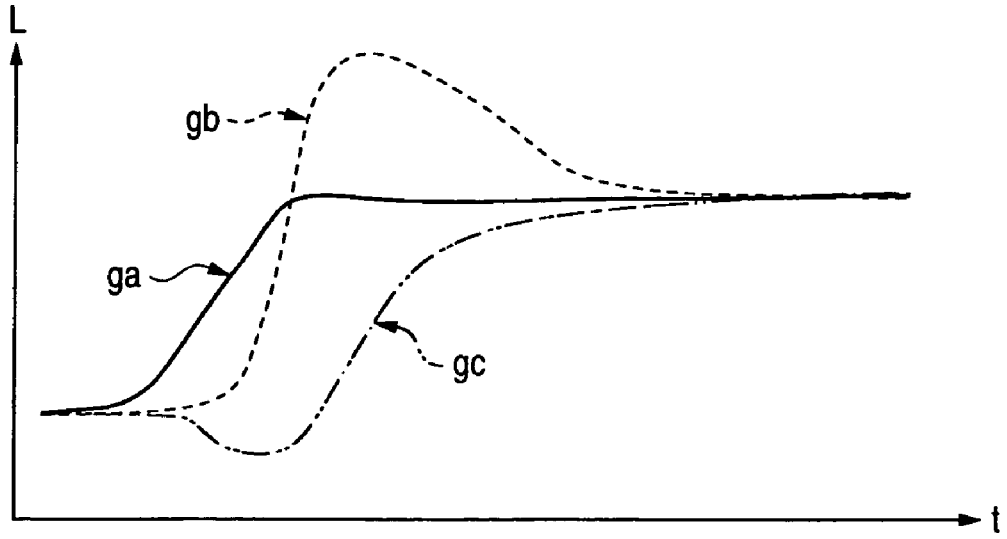
FIG. 7 is a diagram for explaining related art problems by referring to FIGS. 8 and 9, and by showing a time-transient change in a luminous flux.
Figure 8:
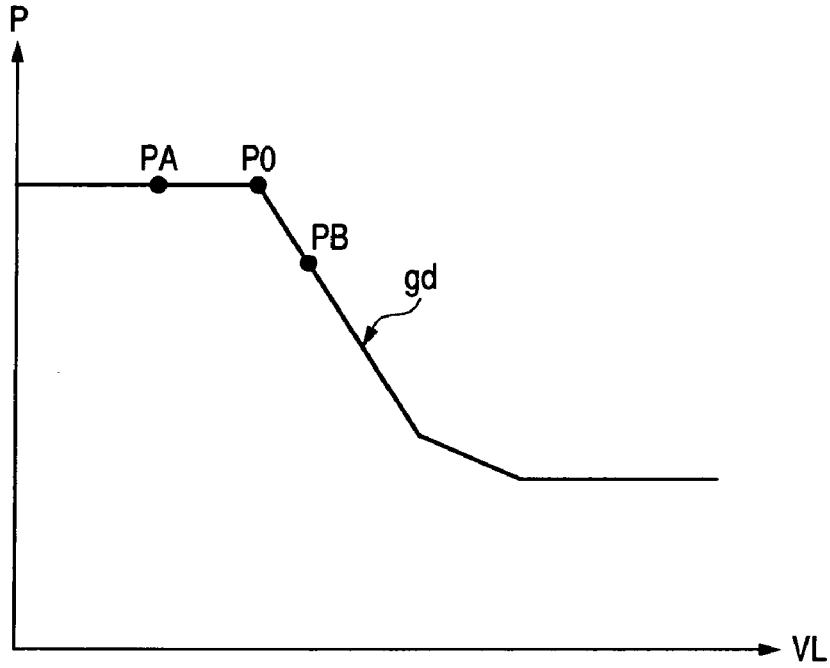
FIG. 8 is a diagram for explaining a related art lamp voltage—power characteristic.
Figure 9:
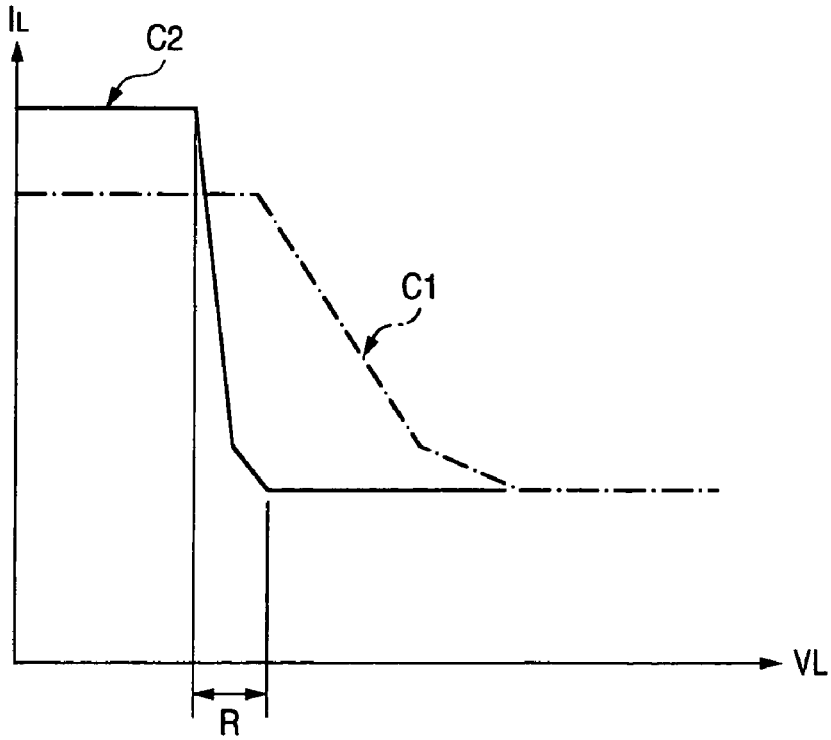
FIG. 9 is a diagram showing a related art lamp voltage—lamp current characteristic.

FIG. 6 is a graph showing an example relationship between elapsed time (t) and the maximum power Pmax of the power supplied to the discharge lamp, wherein the horizontal axis represents the elapsed time (t) and the vertical axis represents the maximum value Pmax. As shown in graph curve g3, the maximum value Pmax is gradually reduced as time elapses following the lighting start point.

As described above, according to the first aspect of the invention, in the process for controlling the power supplied to the discharge lamp during the transition period, the speed for reducing the supplied power is controlled in accordance with the lamp voltage, so that the luminous flux can rise quickly, and the start time period can be reduced and be stabilized.

According to the second aspect of the invention, since the reduction coefficient consonant with the lamp voltage is defined in advance, the speed at which the supplied power is reduced can be controlled.

According to the third aspect of the invention, since the power control process is performed while taking into account the variances in the lamp characteristics, the rising time for the luminous flux can be stabilized.

According to the fourth aspect of the invention, a satisfactory rising characteristic can be obtained for the luminous flux of the discharge lamp, and overshoot can be prevented.

According to the fifth aspect of the invention, a satisfactory rising characteristic can be obtained for the luminous flux of the discharge lamp, and undershoot can be prevented.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A discharge lamp lighting circuit comprising:

an emission acceleration controller that detects a voltage of a discharge lamp, wherein said emission acceleration controller supplies power in an amount greater than a rated value when the discharge lamp is initially lighted and thereafter gradually reduces the supplied power to shift the discharge lamp to a steady state, wherein the emission acceleration controller controls the power of the discharge lamp, so that the speed at which, during at least a portion of a period of transition to the steady state, the power is reduced increases as the voltage of the discharge lamp increases.

2. The discharge lamp lighting circuit according to 1, wherein an upper limit value for the power supplied is reduced when an elapsed time period beginning at the start of the lighting of the discharge lamp is extended.

3. The discharge lamp lighting circuit according to claim 1, wherein a lower limit value of the power supplied is reduced when the voltage of the discharge lamp is high.

4. The discharge lamp lighting circuit according to claim 1, wherein a reduction coefficient that determines a rate of the reduction in the power supplied during the period of transition is a positive value equal to or smaller than one, and decreases as the voltage of the discharge lamp increases.

5. The discharge lamp lighting circuit according to claim 4, wherein the voltage of the discharge lamp is compared with a first threshold value and a second threshold value that is smaller than the first threshold value; and wherein, when the voltage of the discharge lamp is equal to or greater than the first threshold value, the reduction coefficient is defined as a constant value smaller than one and when the voltage of the discharge lamp is smaller than the second threshold value, the reduction coefficient is defined as one.

6. The discharge lamp lighting circuit according to claim 1 wherein the emission acceleration controller controls the power of the discharge lamp, so that the speed at which, during a portion of a period of transition to the steady state, the power is reduced decreases as the voltage of the discharge lamp increases.

7. The discharge lamp lighting circuit according to claim 6 wherein the emission acceleration controller controls the power of the discharge lamp, so that the portion of the period in which the speed at which the power is reduced increases occurs before the portion of the period in which the speed at which power is reduced decreases.

8. The discharge lamp lighting circuit according to claim 1, wherein the discharge lamp has no mercury.

* * * * *